US007399370B2

(12) United States Patent
Inoue et al.

(10) Patent No.: US 7,399,370 B2
(45) **Date of Patent: *Jul. 15, 2008**

(54) CU-BASE AMORPHOUS ALLOY

(75) Inventors: Akihisa Inoue, Miyagi (JP); Wei Zhang, Miyagi (JP)

(73) Assignee: Japan Science and Technology Agency, Kawaguchi-shi (JP)

( * ) Notice: Subject to any disclaimer, the term of this patent is extended or adjusted under 35 U.S.C. 154(b) by 354 days.

This patent is subject to a terminal disclaimer.

(21) Appl. No.: 10/525,738

(22) PCT Filed: Jun. 12, 2003

(86) PCT No.: PCT/JP03/07460

§ 371 (c)(1),
(2), (4) Date: Sep. 20, 2005

(87) PCT Pub. No.: WO2004/022811

PCT Pub. Date: Mar. 18, 2004

(65) Prior Publication Data

US 2006/0144475 A1 Jul. 6, 2006

(30) Foreign Application Priority Data

Aug. 30, 2002 (JP) ..... 2002-255529

(51) Int. Cl.
*C22C 45/00* (2006.01)

(52) U.S. Cl. ..... 148/403; 420/489; 420/492

(58) Field of Classification Search ..... 148/403
See application file for complete search history.

(56) References Cited

U.S. PATENT DOCUMENTS 5,980,652 A * 11/1999 Inoue et al. ..... 148/403

7,056,394 B2 * 6/2006 Inoue et al. ..... 148/403

FOREIGN PATENT DOCUMENTS

| | | |
|---|---|---|
| JP | 9-20968 | 1/1997 |
| JP | 11-61289 | 3/1999 |
| WO | WO 00/26425 | 5/2000 |
| WO | WO 02/053791 A1 | 7/2002 |

* cited by examiner

*Primary Examiner*—George Wyszomierski
(74) *Attorney, Agent, or Firm*—Westerman, Hattori, Daniels & Adrian, LLP.

(57) ABSTRACT

To provide a Cu-based amorphous alloy having a glass-forming ability higher than that of a Cu—Zr—Ti amorphous alloy and a Cu—Hf—Ti amorphous alloy, as well as excellent workability and excellent mechanical properties without containing large amounts of Ti.

A Cu-based amorphous alloy characterized by containing 90 percent by volume or more of amorphous phase having a composition represented by Formula: $Cu_{100-a-b}(Zr,Hf)_a(Al,Ga)_b$ [in Formula, a and b are on an atomic percent basis and satisfy 35 atomic percent≦a≦50 atomic percent and 2 atomic percent≦b≦10 atomic percent], wherein the temperature interval ΔTx of supercooled liquid region is 45 K or more, the temperature interval being represented by Formula ΔTx=Tx−Tg (where Tx represents a crystallization initiation temperature and Tg represents a glass transition temperature.), a rod or a sheet having a diameter or thickness of 1 mm or more and a volume fraction of amorphous phase of 90% or more can be produced by a metal mold casting method, the compressive strength is 1,900 MPa or more, the Young's modulus is 100 GPa or more, and the Vickers hardness is 500 Hv or more.

6 Claims, 3 Drawing Sheets

CU-BASE AMORPHOUS ALLOY

TECHNICAL FIELD

The present invention relates to a Cu-based amorphous alloy having a high amorphous-forming ability, excellent mechanical properties, and a high Cu content.

BACKGROUND ART

It is well known that amorphous solids in various shapes, e.g., in the shape of a thin ribbon, a filament, or a powder and granular material, can be produced by rapid solidifying alloys in a molten state. An amorphous alloy thin ribbon can be prepared by various methods, e.g., a single-roll process, a twin-roll process, an in-rotating liquid spinning process, or an atomization process, which can provide high cooling rates. Therefore, a number of Fe-based, Ti-based, Co-based, Zr-based, Ni-based, Pd-based, or Cu-based amorphous alloys have been developed, and properties specific to amorphous alloys, e.g., excellent mechanical properties and high corrosion resistance, have been made clear. For example, with respect to Cu-based amorphous alloys, researches have been made primarily on binary Cu—Ti or Cu—Zr or ternary Cu—Ni—Zr, Cu—Ag-RE, Cu—Ni—P, Cu—Ag—P, or Cu—Mg-RE.

These Cu-based amorphous alloys have a poor glass-forming ability and, therefore, amorphous alloys of only thin ribbon shaped, powder-shaped, fiber-shaped, and the like have been able to be produced by a liquid quenching technique. Since high thermal stability is not exhibited and it is difficult to form into the shape of a final product, industrial applications thereof are significantly limited.

It is known that an amorphous alloy exhibits high stability against crystallization and has a high amorphous-forming ability, the amorphous alloy exhibiting glass transition and having a large supercooled liquid region and a high reduced glass transition temperature (Tg/Tl). Such a bulk-shaped amorphous alloy can be produced by a metal mold casting method. On the other hand, it is known that when an amorphous alloy is heated, transition to a supercooled liquid state is effected before crystallization and a sharp reduction in viscosity is exhibited with respect to a specific alloy system. In such a supercooled liquid state, since the alloy has a reduced viscosity, an amorphous alloy molded article in an arbitrary shape can be produced by a closed forging process or the like. Consequently, it can be said that an alloy having a large supercooled liquid region and a high reduced glass transition temperature (Tg/Tl) has a high amorphous-forming ability and excellent workability.

Research and development on a large size Cu-based amorphous alloy in consideration of practical use, put another way, on a Cu-based amorphous alloy having an excellent amorphous-forming ability and a high Cu content have made little headway. A nonmagnetic elinvar alloy used for an elastic effector has been invented (Patent Document 1), while the alloy is represented by a general formula $Cu_{100-a-b-c}M_aX_bQ_c$ (M represents at least one element of Zr, RE, and Ti, X represents at least one element of Al, Mg, and Ni, and Q represents at least one element of Fe, Co, V, Nb, Ta, Cr, Mo, W, Mn, Au, Ag, Re, platinum group elements, Zn, Cd, Ga, In, Ge, Sn, Sb, Si, and B). However, specific examples of compositions include only those containing Cu at contents of a low 40 atomic percent or less, and with respect to the mechanical properties, only an example in which the Vickers hardness (20° C. Hv) is 210 to 485 is reported. Furthermore, a nonmagnetic metal glassy alloy used for strain gauges has been invented (Patent Document 2), while the alloy has an alloy composition similar to this.

In 2001, the inventors of the present invention developed a Cu-based Cu—Zr—Ti and Cu—Hf—Ti amorphous alloys having an excellent amorphous-forming ability, and applied for a patent (Patent Document 3).

Patent Document 1 Japanese Unexamined Patent Application Publication No. 09-20968

Patent Document 2 Japanese Unexamined Patent Application Publication No. 11-61289

Patent Document 3 WO 02/053791 A1

DISCLOSURE OF INVENTION

A $Cu_{60}Zr_{40}$ amorphous alloy has ΔTx=55 K. However the mechanical properties, e.g., compressive strength, are not satisfactory. It is preferable to add 5 to 30 atomic percent of Ti thereto as an element to improve the amorphous-forming ability. However, the ΔTx of this Cu—Zr—Ti amorphous alloy is about 30 to 47 K and, therefore, it cannot be said that the alloy has adequately excellent workability. Although a Cu—Hf—Ti or Cu—Zr—Hf—Ti amorphous alloy has a ΔTx larger than that of the Cu—Zr—Ti amorphous alloy, a Hf metal is significantly expensive compared with a Zr metal and, therefore, is not suitable for practical use.

Accordingly, it is an object of the present invention to provide a Cu-based amorphous alloy having a glass-forming ability higher than that of a Cu—Zr—Ti amorphous alloy and a Cu—Hf—Ti amorphous alloy, as well as excellent workability and excellent mechanical properties without containing large amounts of Ti in contrast to the above-described Cu-based amorphous alloy.

In order to overcome the above-described problems, the inventors of the present invention conducted research on an optimum composition of the Cu-based amorphous alloy, and as a result, found out that an amorphous phase rod (sheet) exhibiting a supercooled liquid region ΔTx of 45 or more and having a diameter (thickness) of 1 mm or more was able to be attained by melting an alloy having a specific composition containing Zr and/or Hf, Al and/or Ga, and the remainder, Cu, followed by quenching from the liquid state to solidify, and thereby, a Cu-based amorphous alloy having a high glass-forming ability as well as excellent workability and excellent mechanical properties was able to be attained. Consequently, the present invention was completed.

A Cu-based amorphous alloy according to an aspect of the present invention is characterized by containing 90 percent by volume or more of amorphous phase having a composition represented by Formula: $Cu_{100-a-b}(Zr,Hf)_a(Al,Ga)_b$ [in Formula, a and b are on an atomic percent basis and satisfy 35 atomic percent≦a≦50 atomic percent and 2 atomic percent≦b≦10 atomic percent], wherein the temperature interval ΔTx of supercooled liquid region is 45 K or more, the temperature interval being represented by Formula ΔTx=Tx−Tg (where Tx represents a crystallization initiation temperature and Tg represents a glass transition temperature.), a rod or a sheet having a diameter or thickness of 1 mm or more and a volume fraction of amorphous phase of 90% or more can be produced by a metal mold casting method, the compressive strength is 1,900 MPa or more, the Young's modulus is 100 GPa or more, and the Vickers hardness is 500 Hv or more.

Furthermore, a Cu-based amorphous alloy according to another aspect of the present invention is characterized by containing 90 percent by volume or more of amorphous phase having a composition represented by Formula: $Cu_{100-a-b}(Zr,Hf)_a(Al,Ga)_bM_cT_dQ_e$ [in Formula, M represents at least one element selected from the group consisting of Fe, Ni, Co, Ti, Cr, V, Nb, Mo, Ta, W, Be, and rare-earth elements, T represents at least one element selected from the group consisting of Ge, Sn, Si, and B, Q represents at least one element selected from the group consisting of Ag, Pd, Pt, and Au, a, b, c, d, and e are on an atomic percent basis and satisfy 35 atomic percent≦a≦50 atomic percent, 2 atomic percent≦b≦10 atomic percent, 0≦c≦5%, 0≦d≦5%, 0≦e≦5%, and b+c+d+e≦15 atomic percent], wherein the temperature interval ΔTx of supercooled liquid region is 45 K or more, the temperature interval being represented by Formula ΔTx=Tx−Tg (where Tx represents a crystallization initiation temperature and Tg represents a glass transition temperature.), a rod or a sheet having a diameter or thickness of 1 mm or more and a volume fraction of amorphous phase of 90% or more can be produced by a mold casting method, the compressive strength is 1,900 MPa or more, the Young's modulus is 100 GPa or more, and the Vickers hardness is 500 Hv or more.

In the above-described compositional formula, (Zr,Hf) refers to Zr and/or Hf, (Al,Ga) refers to Al and/or Ga. Therefore, the above-described Formula: $Cu_{100-a-b}(Zr,Hf)_a(Al,Ga)_b$ is any one of the following formulae.

$Cu_{100-a-b}Zr_aAl_b$, $Cu_{100a-b}Hf_aAl_b$, $Cu_{100-a-b}Zr_aGa_b$, $Cu_{100-a-b}Hf_aGa_b$, $Cu_{100-a-b}(Zr+Hf)_aAl_b$, $Cu_{100-a-b}(Zr+Hf)_aGa_b$, $Cu_{100-a-b}(Zr+Hf)_a(Al+Ga)_b$

With respect to the Cu-based amorphous alloy according to the present invention, the temperature interval ΔTx of supercooled liquid region is 45 K or more, the temperature interval being represented by the formula ΔTx=Tx−Tg (where Tx represents a crystallization initiation temperature and Tg represents a glass transition temperature.), the reduced glass transition temperature represented by Tg/Tl (where Tl represents a liquid phase line temperature of an alloy) is 0.57 or more, and a rod or a sheet having a diameter or thickness of 1 mm or more and a volume fraction of amorphous phase of 90% or more can be produced by a metal mold casting method.

In the present specification, the term "supercooled liquid region" is defined by the difference between a glass transition temperature and a crystallization temperature, which are determined by a differential scanning calorimetric analysis performed at a heating rate of 40 K per minute. The "supercooled liquid region" is a numerical value indicative of resistance against crystallization, that is, the stability and the workability of an amorphous material. The alloys of the present invention have supercooled liquid regions ΔTx of 45K or more. In the present specification, the term "reduced glass transition temperature" is defined by a ratio of the glass transition temperature (Tg) to an alloy liquid phase line temperature (Tl) which is determined by a differential thermal analysis (DTA) performed at a heating rate of 40 K per minute. The "reduced glass transition temperature" is a numerical value indicative of an amorphous-forming ability.

BEST DESCRIPTION FOR CARRYING OUT THE INVENTION

Figure 1:
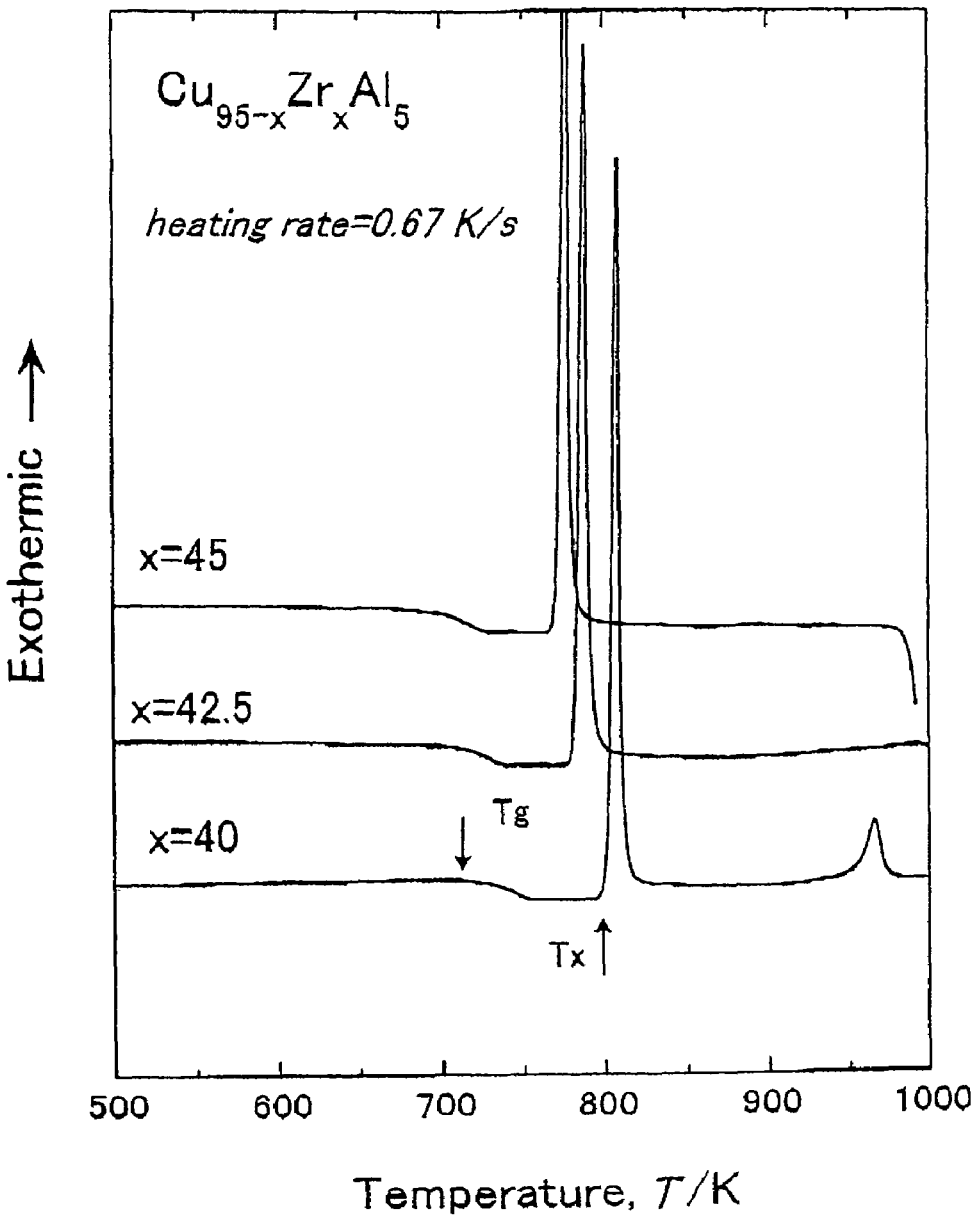
FIG. 1 is a graph showing DSC curves of amorphous bulk materials of Cu—Zr—Al ternary alloys.

The embodiments of the present invention will be described below. In the Cu-based amorphous alloy of the present invention, Zr and Hf are basic elements to form an amorphous material. The amount of Zr and Hf is 35 atomic percent or more and 50 atomic percent or less, and more preferably, is 40 atomic percent or more and 45 atomic percent or less.

When the amount of Zr and Hf is 35 atomic percent or more, the ΔTx becomes 45 k or more, and the workability is improved. In particular, when the amount of Zr is 40 atomic percent or more, the ΔTx becomes 50 k or more.

The elements Al and Ga are fundamental elements of the alloys of the present invention and, in particular, have the effect of significantly enhancing the amorphous-forming ability of Cu—(Zr,Hf) alloys. The amount of the elements Al and Ga is 2 atomic percent or more and 10 atomic percent or less, and more preferably, is 2.5 atomic percent or more and 9 atomic percent or less.

The amount of Cu is specified to be 40 atomic percent or more and less than 63 atomic percent. If the amount of Cu is less than 40 atomic percent, the glass-forming ability and the strength are reduced. If the amount of Cu becomes 63 atomic percent or more, the temperature interval ΔTx of the supercooled liquid region is decreased and the glass-forming ability is reduced. More preferably, the range is 50 atomic percent or more and 60 atomic percent or less.

The total amount of Zr, Hf, and Cu is 90 atomic percent or more and 98 atomic percent or less. If the total amount is less than 90 atomic percent, desired mechanical properties cannot be attained. If the total amount exceeds 98 atomic percent, a shortage of the elements Al and Ga to enhance the amorphous-forming ability occurs and, thereby, the glass-forming ability is reduced. More preferably, the range is 91 atomic percent or more and 97.5 atomic percent or less.

An addition of small amounts of Fe, Ni, Co, Ti, Cr, V, Nb, Mo, Ta, W, or a rare-earth element to the above-described basic alloy composition is effective at increasing the strength. However, the amorphous-forming ability is deteriorated. Therefore, when the addition is performed, the amount is specified to be 5 atomic percent or less.

An addition of small amounts of element Ge, Sn, Si, or B increases the range of the supercooled liquid region. However, if the amount exceeds 5 atomic percent, the amorphous-forming ability is deteriorated. Therefore, when the addition is performed, the amount is specified to be 5 atomic percent or less.

Furthermore, the range of the supercooled liquid region is increased by an addition of up to 5 atomic percent of an element Ag, Pd, Au, or Pt. However, if the amount exceeds 5 atomic percent, the amorphous-forming ability is deteriorated. Therefore, when the addition is performed, the amount is specified to be 5 atomic percent or less. The total of the amount of these additional elements and the amounts of elements Al and Ga, that is, b+c+d+e in the above-described compositional formula, is specified to be 15 atomic percent or less, and more preferably, be 10 atomic percent or less. If the total amount exceeds 15 atomic percent, the glass-forming ability is reduced to an undesirable degree.

The Cu-based amorphous alloy of the present invention in a molten state can be quenched and solidified by various known methods, e.g., a single-roll process, a twin-roll process, an in-rotating liquid spinning process, or an atomization process and, thereby, an amorphous solid in the shape of a thin ribbon, a filament, or a powder and granular material, can be produced. Since the Cu-based amorphous alloy of the present invention has a high amorphous-forming ability, an amorphous alloy in an arbitrary shape can be produced not only by the above-described known production methods, but also by filling a molten metal in a metal mold so as to cast. For example, in a typical metal mold casting method, an alloy is melted in an argon atmosphere in a quartz tube and, thereafter, the molten metal is filled in a copper mold at an ejection pressure of 0.5 to 1.5 Kg·f/cm$^2$ and is solidified, so that an bulk amorphous alloy can be produced. In addition, production methods, e.g., a die casting method and a squeeze casting method, can also be applied.

EXAMPLES

The examples of the present invention will be described below. Mother alloys were prepared through melting from materials having alloy compositions shown in Table 1 (Examples 1 to 23) by an arc melting method. Thereafter, thin ribbon samples of about 20 μm were prepared by a single-roll liquid quenching process. Subsequently, the glass transition temperature (Tg) and the crystallization initiation temperature (Tx) of the thin ribbon sample were measured with a differential scanning calorimeter (DSC). The supercooled liquid region (Tx−Tg) was calculated from these values. The liquid phase line temperature (Tl) was measured by a differential thermal analysis (DTA). The reduced glass transition temperature (Tg/Tl) was calculated from these values. A rod-shaped sample having a diameter of 1 mm was prepared by the mold casting method, and an amorphous state of the sample was checked by an X-ray diffraction method.

The volume fraction (Vf-amo.) of amorphous phase contained in the sample was evaluated by using DSC based on the comparison of calorific value of the sample during crystallization with that of a completely amorphous thin ribbon having a thickness of about 20 μm. These evaluation results are shown in Table 1. Furthermore, a compression test piece was prepared. A compression test was performed with an Instron type testing machine, and the compressive strength (σf) and the Young's modulus (E) were evaluated. The Vickers hardness (Hv) was measured. The measurement results are shown in Table 2.

Figure 2:
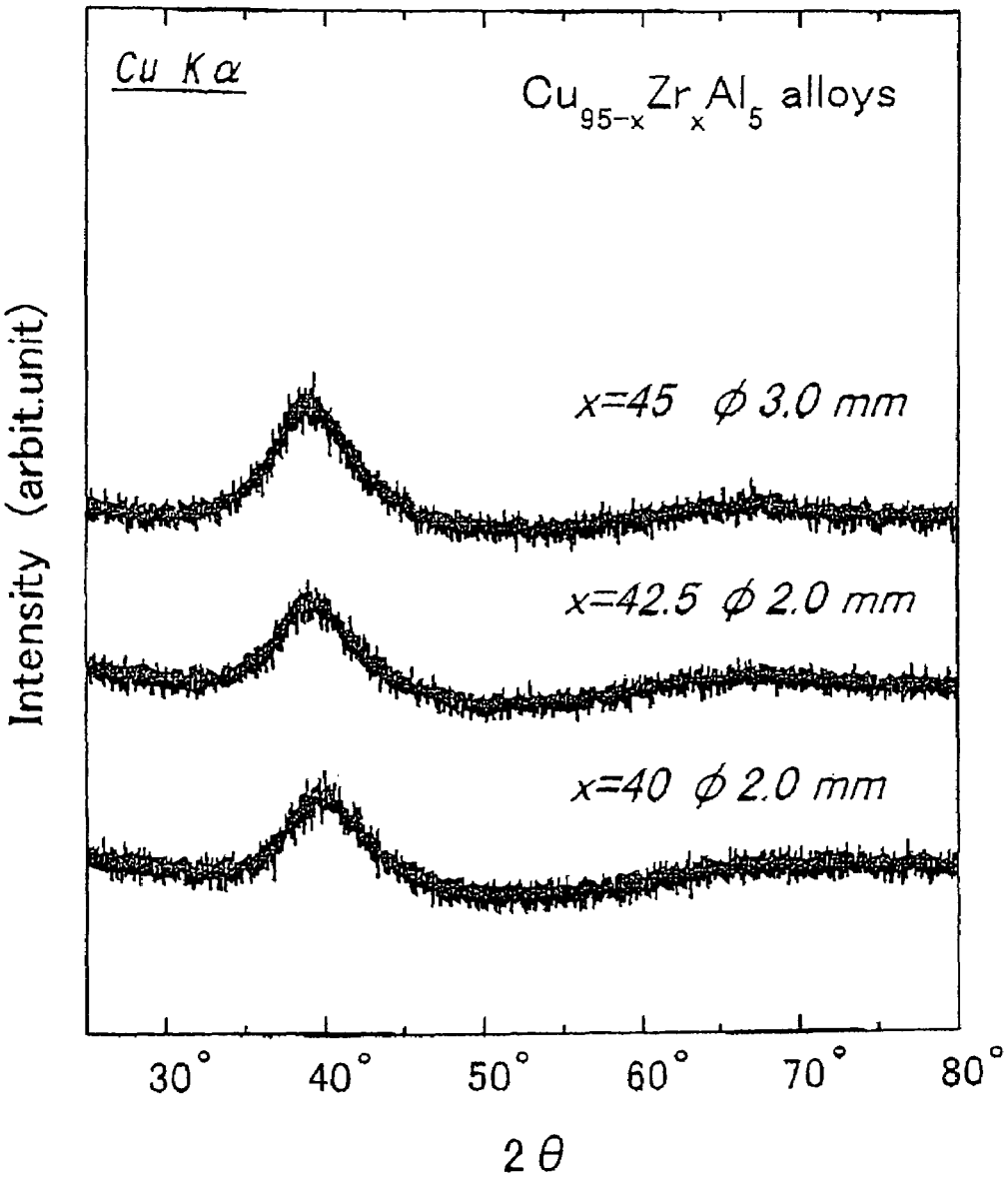
FIG. 2 is a graph showing X-ray diffraction patterns of the amorphous bulk materials of the Cu—Zr—Al ternary alloys.
Figure 3:
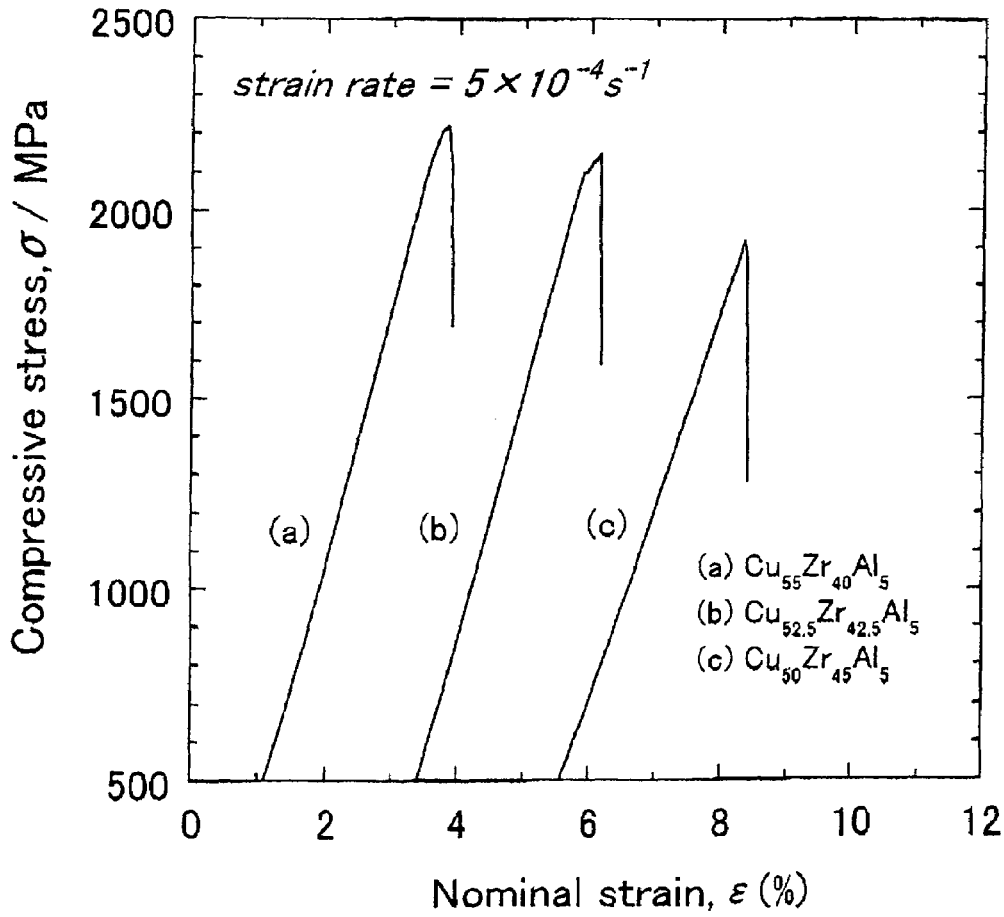
FIG. 3 is a graph showing stress-strain curves based on a compression test of the Cu—Zr—Al amorphous alloy bulk materials having a diameter of 2 mm.

FIG. 1 shows DSC curves of amorphous bulk materials of Cu—Zr—Al alloys. FIG. 2 shows X-ray diffraction patterns. FIG. 3 shows stress-strain curves based on the compression test of the amorphous bulk materials of the Cu—Zr—Al alloys.

TABLE 1

| | Alloy composition (at %) | $T_g$ (K) | $T_x$ (K) | $T_x - T_g$ (K) | $T_g/T_m$ | $V_f$-Amo. |
|---|---|---|---|---|---|---|
| Example 1 | $Cu_{60}Zr_{35}Al_5$ | 755 | 801 | 46 | 0.59 | 100 |
| Example 2 | $Cu_{55}Zr_{40}Al_5$ | 723 | 800 | 77 | 0.62 | 100 |
| Example 3 | $Cu_{50}Zr_{45}Al_5$ | 701 | 770 | 69 | 0.60 | 100 |
| Example 4 | $Cu_{52.5}Zr_{42.5}Al_5$ | 709 | 781 | 72 | 0.61 | 100 |
| Example 5 | $Cu_{55}Zr_{42.5}Al_{2.5}$ | 705 | 773 | 68 | 0.61 | 100 |
| Example 6 | $Cu_{55}Hf_{40}Al_5$ | 777 | 862 | 85 | 0.60 | 100 |
| Example 7 | $Cu_{50}Hf_{45}Al_5$ | 765 | 857 | 92 | 0.62 | 100 |
| Example 8 | $Cu_{52.5}Hf_{40}Al_{7.5}$ | 779 | 834 | 55 | 0.63 | 100 |
| Example 9 | $Cu_{50}Hf_{42.5}Al_{7.5}$ | 780 | 835 | 55 | 0.63 | 100 |
| Example 10 | $Cu_{52.5}Hf_{42.5}Al_5$ | 771 | 849 | 78 | 0.59 | 100 |
| Example 11 | $Cu_{55}Hf_{37.5}Al_{7.5}$ | 776 | 863 | 87 | 0.61 | 100 |
| Example 12 | $Cu_{55}Hf_{42.5}Al_{2.5}$ | 769 | 831 | 62 | 0.60 | 100 |
| Example 13 | $Cu_{50}Zr_{22.5}Hf_{22.5}Al_5$ | 790 | 843 | 53 | 0.62 | 100 |
| Example 14 | $Cu_{55}Zr_{40}Ga_5$ | 730 | 780 | 50 | 0.61 | 100 |
| Example 15 | $Cu_{42.5}Zr_{42.5}Ga_5$ | 728 | 777 | 49 | 0.61 | 100 |
| Example 16 | $Cu_{55}Hf_{40}Ga_5$ | 784 | 847 | 63 | 0.58 | 100 |
| Example 17 | $Cu_{50}Zr_{45}Al_{2.5}Ga_{2.5}$ | 728 | 792 | 64 | 0.61 | 100 |
| Example 18 | $Cu_{45}Zr_{45}Al_5Ni_5$ | 710 | 775 | 65 | 0.59 | 100 |

TABLE 1-continued

| | Alloy composition (at %) | $T_g$ (K) | $T_x$ (K) | $T_x - T_g$ (K) | $T_g/T_m$ | $V_f$-Amo. |
|---|---|---|---|---|---|---|
| Example 19 | $Cu_{50}Zr_{40}Al_5Nb_5$ | 721 | 771 | 50 | 0.61 | 100 |
| Example 20 | $Cu_{50}Zr_{40}Al_5Au_5$ | 735 | 815 | 80 | 0.61 | 100 |
| Example 21 | $Cu_{50}Zr_{40}Al_5Y_5$ | 721 | 795 | 74 | 0.61 | 100 |
| Example 22 | $Cu_{50}Zr_{45}Al_{2.5}Sn_{2.5}$ | 707 | 785 | 78 | 0.61 | 100 |
| Example 23 | $Cu_{50}Zr_{45}Al_{2.5}B_{2.5}$ | 713 | 792 | 79 | 0.61 | 100 |
| Comparative example 1 | $Cu_{70}Hf_{20}Al_{10}$ | — | — | — | — | 50< |
| Comparative example 2 | $Cu_{70}Hf_{20}Al_{10}$ | — | — | — | — | 50< |
| Comparative example 3 | $Cu_{55}Zr_{20}Al_5Ni_{10}$ | — | — | — | — | 50< |
| Comparative example 4 | $Cu_{60}Al_{40}$ | — | — | — | — | 10< |
| Comparative example 5 | $Cu_{60}Zr_{30}Ti_{10}$ | 713 | 750 | 37 | 0.61 | 100 |
| Comparative example 6 | $Cu_{60}Hf_{20}Ti_{20}$ | 730 | 768 | 38 | 0.61 | 100 |
| Comparative example 7 | $Cu_{60}Zr_{40}$ | 717 | 777 | 60 | 0.60 | 91 |
| Comparative example 8 | $Cu_{55}Zr_{35}Ti_{10}$ | 680 | 727 | 47 | 0.59 | 100 |
| Comparative example 9 | $Cu_{53}Zr_{35}Al_5Ti_7$ | 721 | 753 | 32 | 0.54 | 50< |

TABLE 2

| | Alloy composition (at %) | $\sigma_f$ (MPa) | E (GPa) | Hv |
|---|---|---|---|---|
| Example 1 | $Cu_{60}Zr_{35}Al_5$ | 2265 | 119 | 603 |
| Example 2 | $Cu_{55}Zr_{40}Al_5$ | 2220 | 116 | 581 |
| Example 3 | $Cu_{50}Zr_{45}Al_5$ | 1921 | 103 | 546 |
| Example 4 | $Cu_{52.5}Zr_{42.5}Al_5$ | 2130 | 112 | 568 |
| Example 5 | $Cu_{55}Zr_{42.5}Al_{2.5}$ | 2200 | 115 | 589 |
| Example 6 | $Cu_{55}Hf_{40}Al_5$ | 2280 | 121 | 642 |
| Example 7 | $Cu_{50}Hf_{45}Al_5$ | 2320 | 134 | 667 |
| Example 8 | $Cu_{52.5}Hf_{40}Al_{7.5}$ | 2295 | 128 | 644 |
| Example 9 | $Cu_{50}Hf_{42.5}Al_{7.5}$ | 2372 | 137 | 673 |
| Example 10 | $Cu_{52.5}Hf_{42.5}Al_5$ | 2380 | 137 | 681 |
| Example 11 | $Cu_{55}Hf_{37.5}Al_{7.5}$ | 2412 | 140 | 698 |
| Example 12 | $Cu_{55}Hf_{42.5}Al_{2.5}$ | 2253 | 131 | 692 |
| Example 13 | $Cu_{50}Zr_{22.5}Hf_{22.5}Al_5$ | 2130 | 122 | 591 |
| Example 14 | $Cu_{55}Zr_{40}Ga_5$ | 2219 | 117 | 585 |
| Example 15 | $Cu_{52.5}Zr_{42.5}Ga_5$ | 2100 | 115 | 571 |
| Example 16 | $Cu_{55}Hf_{40}Ga_5$ | 2275 | 126 | 652 |
| Example 17 | $Cu_{50}Zr_{45}Al_{2.5}Ga_{2.5}$ | 2205 | 115 | 691 |
| Example 18 | $Cu_{45}Zr_{45}Al_5Ni_5$ | 2025 | 107 | 569 |
| Example 19 | $Cu_{50}Zr_{40}Al_5Nb_5$ | 2312 | 131 | 674 |
| Example 20 | $Cu_{50}Zr_{40}Al_5Au_5$ | 2245 | 117 | 597 |
| Example 21 | $Cu_{50}Zr_{40}Al_5Y_5$ | 2180 | 114 | 575 |
| Example 22 | $Cu_{50}Zr_{45}Al_{2.5}Sn_{2.5}$ | 2200 | 112 | 561 |
| Example 23 | $Cu_{50}Zr_{45}Al_{2.5}B_{2.5}$ | 2175 | 119 | 559 |
| Comparative example 1 | $Cu_{70}Zr_{20}Al_{10}$ | — | — | 564 |
| Comparative example 2 | $Cu_{70}Hf_{20}Al_{10}$ | — | — | 624 |
| Comparative example 3 | $Cu_{55}Zr_{30}Al_5Ni_{10}$ | — | — | 578 |
| Comparative example 4 | $Cu_{60}Ti_{40}$ | — | — | 566 |
| Comparative example 5 | $Cu_{60}Zr_{30}Ti_{10}$ | 2115 | 114 | 504 |
| Comparative example 6 | $Cu_{60}Hf_{20}Ti_{20}$ | 2080 | 135 | 620 |
| Comparative example 7 | $Cu_{60}Zr_{40}$ | 1880 | 102 | 555 |
| Comparative example 8 | $Cu_{55}Zr_{35}Ti_{10}$ | 1860 | 112 | 567 |
| Comparative example 9 | $Cu_{35}Zr_{35}Al_5Ti_7$ | — | — | 584 |

As is clear from Table 1, with respect to the amorphous alloy of each Example, the Cu—Hf or Cu—Zr—Hf amorphous alloy exhibits ΔTx of a large 50 K or more, even the Cu—Zr amorphous alloy exhibits ΔTx of 45 K or more, the reduced glass transition temperature of 0.57 or more is exhibited, and an amorphous alloy rod having a diameter of 1 mm was readily produced.

On the other hand, in the alloys of Comparative examples 1 and 2, (Al,Ga) is 10 atomic percent while (Zr,Hf) is less than 35 atomic percent, a high glass-forming ability is not exhibited, and no rod-shaped amorphous alloy having a diameter of 1 mm was produced.

In the alloy of Comparative example 3, the amount of Ni exceeds 5 atomic percent, a high glass-forming ability is not exhibited, and no rod-shaped amorphous alloy having a diameter of 1 mm was produced. In the alloy of Comparative example 4, no basic element (Zr,Hf) is present, nor was rod-shaped amorphous alloy having a diameter of 1 mm produced. In the alloys of Comparative examples 5 and 6, no fundamental element (Al,Ga) is present. Although an rod-shaped amorphous alloy having a diameter of 1 mm was produced, the supercooled liquid region is less than 45 K, and excellent workability is not exhibited.

In the alloys of Comparative examples 7 and 8, Zr is 35 atomic percent or more, the supercooled liquid region is 45 K or more, and excellent workability is exhibited. However, the compressive strength is small.

In the alloy of Comparative example 9, when Ti exceeded 5 atomic percent, the reduced glass transition temperature Tg/Tl was significantly reduced and, therefore, no rod-shaped amorphous alloy having a diameter of 1 mm was produced.

As is clear from Table 2, the amorphous alloy of each Example exhibits the compressive fracture strength (σf: MPa) of 1,921 at minimum and 2,412 at maximum, the hardness (room temperature Vickers hardness: Hv) of 546 at minimum and 891 at maximum, and the Young's modulus (E: GPa) of 103 at minimum and 140 at maximum, so that the compressive fracture strength of 1,900 MPa or more, the Vickers hardness of 500 Hv or more, and the Young's modulus of 100 GPa or more are exhibited.

INDUSTRIAL APPLICABILITY

As described above, according to the Cu-based alloy compositions of the present invention, rod-shaped samples of 1 mm or more can be readily prepared by the mold casting method. These amorphous alloys exhibit supercooled liquid regions of 45 K or more and have high strength and high Young's moduli. In this manner, a practically useful Cu-based amorphous alloy having a high amorphous-forming ability as well as excellent workability and excellent mechanical properties can be provided.

The invention claimed is:

1. A Cu-based amorphous alloy product, comprising 90 percent by volume or more of amorphous phase having a composition represented by a first formula: $Cu_{100-a-b}(Zr,Hf)_a(Al,Ga)_b$, where a and b are on an atomic percent basis and satisfy $35 \leqq a \leqq 45$ and $2 \leqq b \leqq 10$, wherein the amorphous phase contains 50 to 60 atomic percent of Cu, wherein the temperature interval ΔTx of supercooled liquid region is 45 K or more, the temperature interval being represented by a second formula: ΔTx=Tx−Tg, where Tx represents a crystallization initiation temperature and Tg represents a glass transition temperature, said product having a diameter or thickness of 1 mm or more and a volume fraction of amorphous phase of 90% or more is produced by a metal mold casting method, the compressive strength is 1,900 MPa or more, the Young's modulus is 100 GPa or more, and the Vickers hardness is 500 Hv or more.

2. The Cu-based amorphous alloy product as defined in claim 1, wherein said a satisfies $40 \leqq a \leqq 45$.

3. The Cu-based amorphous alloy product as defined in claim 1, wherein said b satisfies $2.5 \leqq b \leqq 9$.

4. A Cu-based amorphous alloy product, comprising 90 percent by volume or more of amorphous phase having a composition represented by a third formula: $Cu_{100-a-b}(Zr,Hf)_a(Al,Ga)_bM_cT_dQ_e$, where M represents at least one element selected from the group consisting of Fe, Ni, Co, Cr, V, Nb, Mo, Ta, W, and rare-earth elements, T represents at least one element selected from the group consisting of Ge, Sn, Si, and B, Q represents at least one element selected from the group consisting of Ag, Pd, Pt, and Au, a, b, c, d, and e are on an atomic percent basis and satisfy $35 \leqq a \leqq 45$, $2 \leqq b \leqq 10$, $0 \leqq c \leqq 5$, $0 \leqq d \leqq 5$, $0 \leqq e \leqq 5$, and $b+c+d+e \leqq 10$, wherein the amorphous phase contains 50 to 60 atomic Percent of Cu, wherein the temperature interval ΔTx of supercooled liquid region is 45 K or more, the temperature interval being represented by a fourth formula: ΔTx=Tx−Tg, where Tx represents a crystallization initiation temperature and Tg represents a glass transition temperature, wherein said product having a diameter or thickness of 1 mm or more and a volume fraction of amorphous phase of 90% or more is produced by a metal mold casting method, the compressive strength is 1,900 MPa or more, the Young's modulus is 100 GPa or more, and the Vickers hardness is 500 Hv or more.

5. The Cu-based amorphous alloy product as defined in claim 4, wherein said a satisfies $40 \leqq a \leqq 45$.

6. The Cu-based amorphous alloy product as defined in claim 4, wherein said b satisfies $2.5 \leqq b \leqq 9$.

* * * * *